US005110636A

United States Patent [19]

Hou

[11] Patent Number: 5,110,636

[45] Date of Patent: May 5, 1992

[54] DECORATIVE DISPLAY DEVICE

[75] Inventor: Jack Hou, Taipei, Taiwan

[73] Assignee: Giftec, Ltd., Alexandria, Va.

[21] Appl. No.: 650,877

[22] Filed: Feb. 5, 1991

[51] Int. Cl.[5] ..... G09F 19/00

[52] U.S. Cl. ..... 428/11; 40/410; 40/455; 84/95.1; 428/13; 446/267; 446/408

[58] Field of Search ..... 428/7, 13, 11; 40/410, 40/455; 84/95.1; 446/267, 408

[56] References Cited

U.S. PATENT DOCUMENTS

| | | | |
|---|---|---|---|
| Re. 23,612 | 1/1953 | Abel | 446/166 |
| 1,083,064 | 12/1913 | Downey | 238/78 |
| 1,471,885 | 10/1923 | Dessau | 446/153 |
| 1,741,692 | 12/1929 | Garaja | 428/13 |
| 2,115,986 | 5/1938 | Da Costa | 428/13 X |
| 2,361,423 | 10/1944 | Snyder | 446/153 X |
| 2,601,658 | 6/1952 | Bussert | 428/13 X |
| 2,621,042 | 12/1952 | Stein et al. | 40/410 X |
| 2,686,642 | 8/1954 | Dobarganes et al. | 40/406 X |
| 2,709,217 | 5/1955 | McCluskey | 428/13 X |
| 3,239,956 | 3/1966 | Canonica, Jr. | 40/426 |
| 3,308,705 | 3/1967 | Shinnick | 428/7 X |
| 3,349,661 | 10/1967 | Searls | 428/13 X |
| 3,499,238 | 3/1970 | Publicker | 40/406 |
| 3,535,805 | 10/1970 | Peiperl | 40/406 |
| 3,905,140 | 9/1975 | Damiano | 428/19 X |
| 4,196,899 | 4/1980 | Patterson | 428/13 X |
| 4,203,241 | 5/1980 | Wallace | 40/406 |
| 4,221,078 | 9/1980 | Latham et al. | 428/13 X |
| 4,490,931 | 1/1985 | Fleemin | 40/406 |
| 4,521,982 | 6/1985 | Altuchow | 40/406 X |
| 4,641,445 | 2/1987 | Rossi | 40/430 X |
| 4,757,986 | 7/1988 | Hwang et al. | 40/426 X |
| 4,771,902 | 9/1988 | Teng | 428/13 X |
| 4,817,311 | 4/1989 | Ong | 40/406 X |
| 4,852,283 | 8/1989 | Teng | 40/410 X |
| 4,928,412 | 5/1990 | Nishiyama | 40/406 X |
| 4,961,276 | 10/1990 | Lin | 40/410 |

FOREIGN PATENT DOCUMENTS

| | | | |
|---|---|---|---|
| 3618952 | 12/1987 | Fed. Rep. of Germany | 446/267 |
| 7809141 | 2/1979 | France | 40/406 |
| 1183139A | 10/1985 | U.S.S.R. | 446/267 |
| 1083064 | 9/1967 | United Kingdom | 40/410 |
| 2080129 | 2/1982 | United Kingdom . | |

*Primary Examiner*—Henry F. Epstein
*Attorney, Agent, or Firm*—Bacon & Thomas

[57] ABSTRACT

A display device wherein decorative objects are immersed in a liquid-filled housing which is rotatably mounted on a base and driven by a windup music box mechanism through a transmission assembly so that rotation of the housing relative to the base in a first direction winds up the music box mechanism which, during unwinding and the production of music, causes the housing to rotate in a second opposite direction.

9 Claims, 2 Drawing Sheets

DECORATIVE DISPLAY DEVICE

BACKGROUND OF THE OF THE INVENTION

1. Field of the Invention

The present invention generally involves the field of technology pertaining to devices for displaying ornamental objects, and more particularly to an improved liquid filled ball device for displaying objects immersed within the liquid.

2. Description of the Prior Art

A decorative device in the form of a paper weight or similar novelty item wherein a transparent housing is sealed with decorative objects immersed in liquid and supported on a display base is well known. For example, the housing may contain a figure of a snowman and particles of white material simulating snow immersed within the liquid, so that manual agitation of the device by the user will cause a temporary suspending of the particles in the liquid. When the device is then placed on a support surface, the particles slowly settle on the figure and to the bottom of the housing, thereby simulating snow fall.

More sophisticated versions of these devices are also known wherein a drive motor is provided within the base of the device to create agitation of the liquid for imparting movement to objects immersed or suspended therein. These versions generally utilize an indirect magnetic drive for agitation of the liquid by disposing a first magnetic member in the liquid and positioning a second corresponding magnetic member out of the housing for rotation by the drive motor. Other forms of these devices may also include lighting means associated with the housing for illuminating the immersed objects and enhancing the ornamental display effect.

Display devices of the aforementioned types generally include a spherical housing formed of glass or transparent plastic material having a bottom opening defined by an outwardly extending neck portion which permits the housing to be filled with the required liquid and decorative objects. The bottom opening is sealed with a liquidtight gasket which may be frictionally or threadedly engaged around the neck portion. The sealed neck portion is then inserted within a base which supports the housing in a manner to permit viewing the decorative objects through the liquid from substantially all sides of the housing.

SUMMARY OF THE INVENTION

It is an object of the invention to provide an improved decorative display device.

It is another object of the invention to provide an improved display device wherein decorative objects are immersed in a liquid filled transparent spherical housing supported on a base.

It is a further object of the invention to provide a liquid filled display device for an ornamental object wherein movement is imparted to the object by a wind-up drive mechanism which also provides musical accompaniment.

It is yet also an object of the invention to provide an improved liquid filled display device which is simple in construction, economical to manufacture and reliable in operation.

These and other objects of the invention are realized by providing a display device that includes a transparent spherical housing having an outwardly extending neck portion which defines a bottom opening for filling the housing with an appropriate liquid. A cup-shaped sealer provides a liquidtight seal for the bottom opening and includes a top surface for supporting an ornament in the liquid. The neck portion and sealer are inserted through a circular opening of a base and provided with a drive shaft which is drivingly connected to the power output shaft of a wind-up music box mechanism through a transmission assembly. The drive shaft and power output shaft are supported for rotation about parallel spaced axes, thereby permitting the utilization of a base having minimum dimensions that will accommodate a wind-up music box mechanism of conventional size and configuration.

Other objects, features and advantages of the invention shall become apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENT

Figure 1:
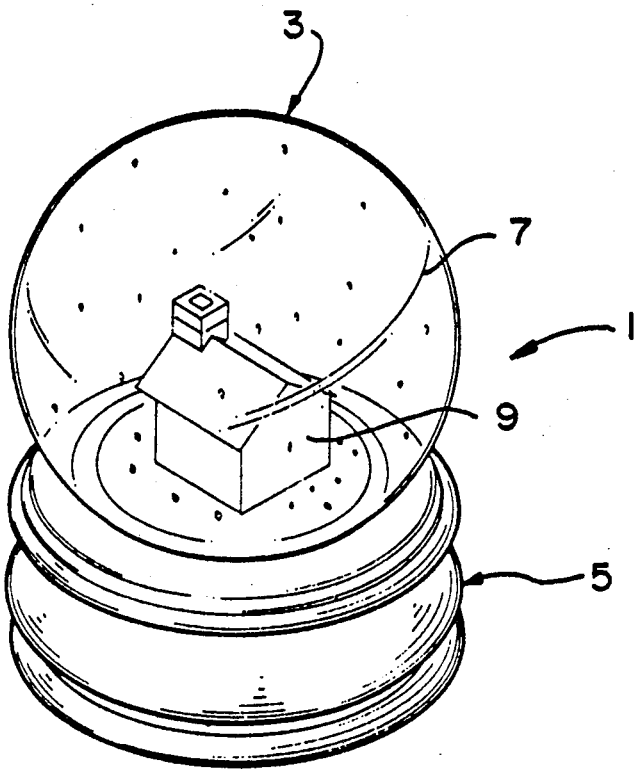
FIG. 1 is a perspective view of a display device according to a preferred embodiment of the invention and shown in its assembled form.

A display device 1 shall now be described with initial reference to FIGS. 1 and 2. As shown therein, device 1 includes a spherical-shaped housing 3 supported on a substantially cylindrical-shaped base 5. Housing 3 may be formed of glass or other suitable transparent material, such as plastic, and is filled with an appropriate transparent liquid 7 within which an ornamental object 9 is immersed for display.

Figure 2:
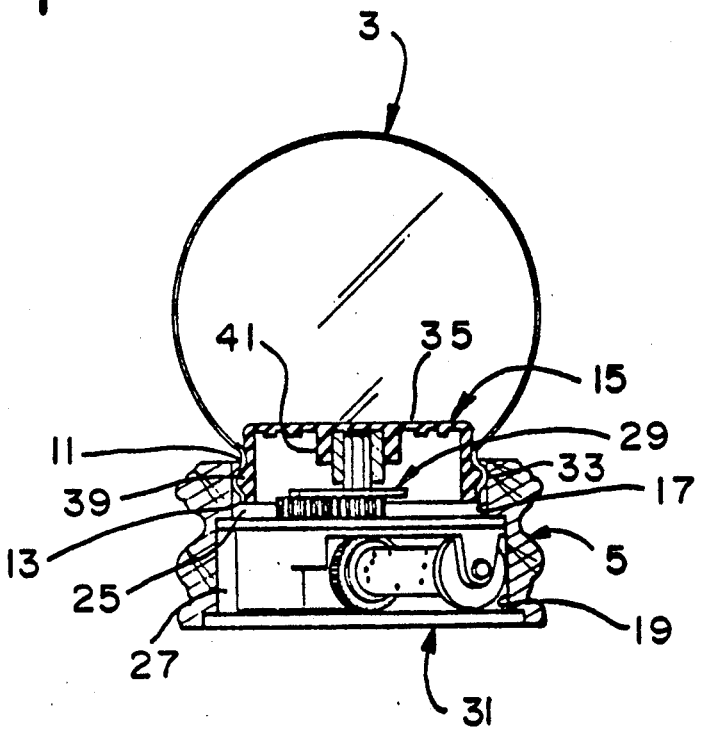
FIG. 2 is a front elevational view, partly in section, of the display device of FIG. 1, particularly showing the manner in which the housing is drivingly connected to the wind-up music box mechanism through the transmission assembly.

As seen in FIG. 2, housing 3 is provided with an outwardly extending circular neck portion 11 which defines a bottom opening 13 through which a cup-shaped sealer 15 is snugly received to form a liquidtight seal against the inner wall of neck portion 11. Base 5 is of substantially hollow construction and includes an interior defined by two cylindrical walls 17 and 19. The diameter of wall 17 is smaller than the diameter of wall 19, thereby defining a transverse annular wall 21 therebetween. A circular support plate 23 having a diameter corresponding substantially to that of wall 19 is positioned against annular wall 21, thereby dividing the interior of base 5 into an upper compartment 25 and a lower compartment 27, the vertical walls of which are formed by walls 17 and 19, respectively.

A transmission assembly 29 is disposed within upper compartment 25, and a conventional wind-up music box mechanism 31 is disposed within lower compartment 27. Transmission assembly 29 serves to drivingly connect sealer 15 to music box mechanism 31 and permits housing 3 to be rotated in opposite directions relative to base 5 in a manner to be hereinafter detailed.

Figure 3:
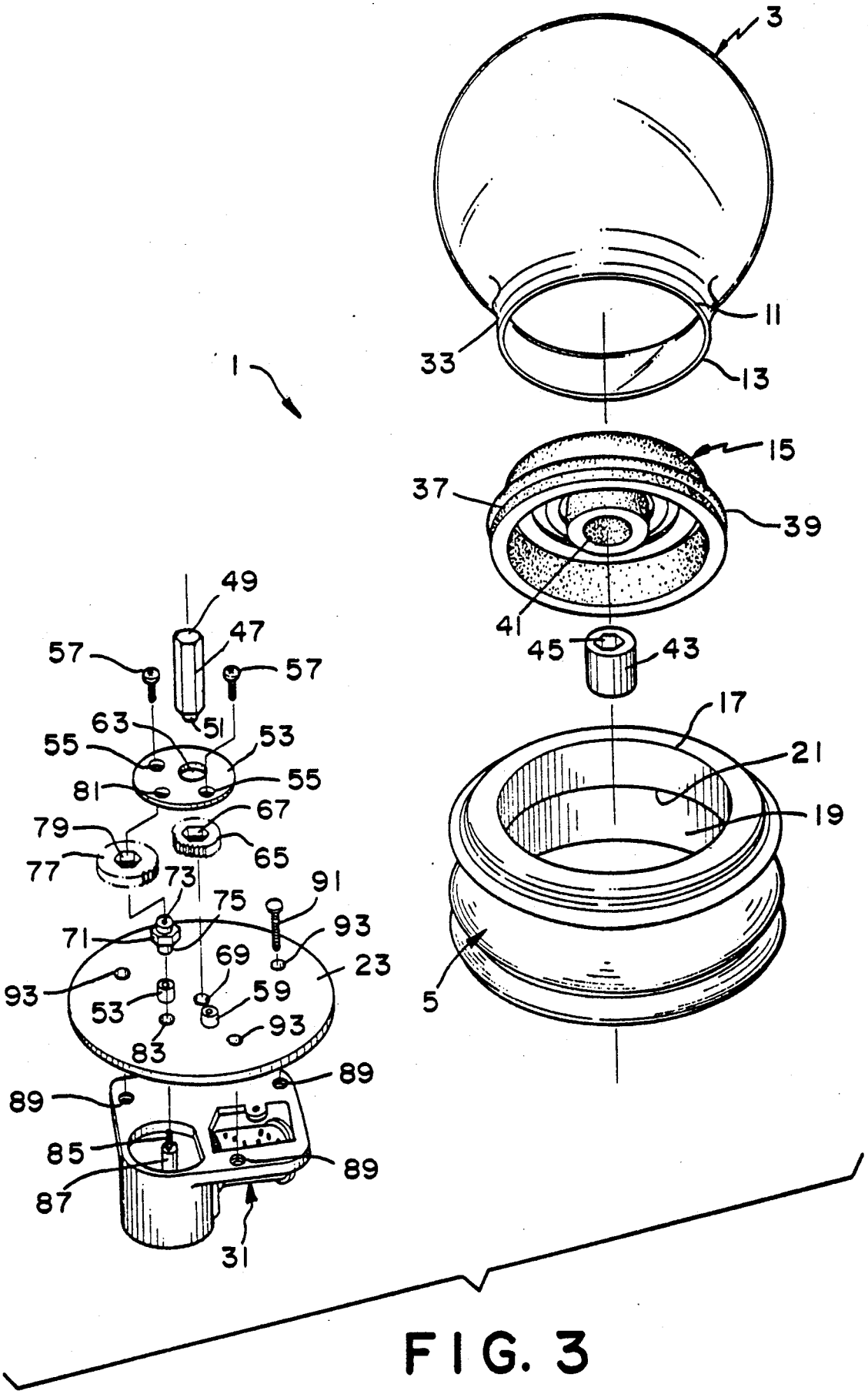
FIG. 3 is an exploded offset perspective view of the display device and particularly showing the individual components forming the device and the manner in which they are assembled together.

With reference to FIG. 3, neck portion of housing 3 includes an outwardly extending annular groove 33 formed around its internal wall. Sealer 15 includes a substantially flat top surface 35 and a downwardly extending annular skirt 37 provided with an outwardly extending annular rib 39 around its outer periphery. Sealer 15 is appropriately sized in correspondence with the internal diameter of neck portion 11 so that it may be snugly and frictionally engaged therein to dispose rib 39 within groove 33, as shown in FIG. 2, to provide a secure liquidtight seal therebetween. When assembled in this manner, sealer 15 is tightly engaged with neck portion 11 to form an integral unit therewith so that rotation of housing 3 causes a corresponding rotation of sealer 15 and vice versa. Sealer 15 also includes a central downwardly extending hollow cylindrical member 41 within which a cylindrical drive socket 43 is frictionally engaged. Socket 43 includes an open-ended longitudinal passageway 45 having a preferably hexagonal transverse cross-section. As further seen in FIG. 2, when sealer 15 is fully engaged with neck portion 11, as previously described, the outer peripheral surface of neck portion 11, as extended by groove 33, has a slightly smaller diameter than that of wall 17 in order to permit free rotation of housing 3 relative to base 5. It is preferred that sealer 15 be integrally formed of a resilient material, such as rubber or other such appropriate material well known in the art for creating the liquidtight seal required for the practice of the invention as described herein.

As also seen in FIG. 3, there is provided a drive shaft 47 having a hexagonal transverse cross-section corresponding to that of passageway 45 of drive socket 43. Drive shaft 45 includes an upper end 49 which is inserted within passageway 45, and a lower end 51 of reduced diameter cylindrical configuration. Transmission assembly 29 includes both drive socket 43 and drive shaft 47. In addition, assembly 29 also includes a circular lock plate 53 provided with a pair of fastener apertures 55 formed therethrough for receiving a pair of corresponding threaded fasteners 57 which are used to secure plate 53 to support plate 23 by engaging a pair of corresponding threaded sockets 59 which extend outwardly from an upper surface 61 of plate 23. When fasteners 57 are threadedly engaged within sockets 59, plate 53 is secured to plate 23 in a parallel and spaced disposition from top surface 61. Plate 53 also includes a shaft aperture 63 having a diameter of sufficient size to permit drive shaft 47 to be inserted therethrough for attachment to a first circular gear wheel 65 positioned on the opposite side of plate 53. Gear wheel 65 is provided with a central hexagonal-shaped passageway 67 corresponding to the cross-section of shaft 47, thereby permitting shaft 47 and gear wheel 65 to be rotated together. Lower end 51 of shaft 47 is received within a corresponding cylindrical aperture 69 formed in plate 23.

Transmission assembly 29 further includes a nut. 71 of preferably hexagonal cross-section. Extending outwardly from opposite sides of nut 71 are an upper threaded socket 73 and a lower threaded socket 75. A second gear wheel 77 having a central hexagonal aperture 79 therethrough corresponding to the hexagonal configuration of nut 71 is engaged on the latter with socket 73 and 75 extending outwardly from opposite sides of gear wheel 77. As apparent, nut 71 and gear wheel 77 are therefore engaged together for joint rotation. Upper socket 73 of nut 71 is rotatably received through a corresponding aperture 81 formed in lock plate 53 and may preferably be secured in place by engaging a threaded fastener (not shown) in socket 73. Likewise, bottom socket 75 is disposed through a corresponding aperture 83 formed in support plate 23 for threaded attachment to a threaded end 85 of a power output shaft 87 extending outwardly from music box mechanism 31.

Support plate 23 may be secured to annular wall 21 of base 5 in any appropriate manner, such as through the use of an adhesive or with mechanical fasteners, such as screws. Music box mechanism 31 is of conventional construction and typically provided with a plurality of threaded sockets 89 therearound for attaching mechanism 31 to plate 23. This may be accomplished by using a plurality of threaded fasteners 91 which are inserted through a plurality of corresponding apertures 93 formed through plate 23 and threadedly engaged within sockets 89.

In the assembled form of device 1 as shown in FIG. 2 and the exploded depiction of transmission 29 as shown in FIG. 3, it is apparent that drive shaft 47 of sealer 15 rotates with housing 3 about an axis of rotation that is coaxial with the central axes of neck portion 11 of housing 3, cylindrical member 41 of sealer 15, drive socket 43 and base 5. It is further apparent that through the use of lock plate 53 and the position of power output shaft 87 of music box mechanism 31, the axis of rotation of shaft 87 is offset or spaced from and parallel to the axis of rotation of shaft 47. The benefit of this arrangement is apparent because the configuration of conventional music box mechanism 31 positions power output shaft 87 adjacent a corner of mechanism 31, a situation which would otherwise require the utilization of a much larger base 5 if the axes of rotation of shafts 47 and 87 are disposed in coaxial alignment with each other. The invention therefore permits the utilization of a smaller structure for base 5, thereby providing the additional advantage of musical accompaniment to device 1 in an overall size which is comparable to that of a conventional display device without a music box mechanism.

As also apparent from FIGS. 1 and 2, sealer 15 includes a top surface 35 which is positioned within housing 3 and on which decorative object 9, or plural such objects 9, may be mounted or supported. In this way, rotation of housing 3 and associated sealer 15 imparts a corresponding movement to object 9.

The operation of display device 1 is accomplished by the user rotating housing 3 relative to base 5 in a first direction. By virtue of transmission assembly 29, rotation of drive shaft 47 imparts a corresponding rotation to power output shaft 87, thereby permitting mechanism 31 to be wound up in a conventional manner. Upon release of housing 3 and the placement of base 5 of device 1 on a support surface, mechanism 31 begins to automatically unwind, thereby rotating power output shaft 87 in an opposite direction and producing an appropriate preselected musical score. Simultaneously, rotation of shaft 87 is imparted through transmission assembly 29 to drive shaft 47, thereby rotating housing 3 in a second opposite direction. This imparts movement to object 9 and creates a moving visual display to musical accompaniment that is visually and aurally pleasing to the user.

Though the invention has been disclosed in accordance with a preferred embodiment thereof, it shall be understood that various changes in size, shape, composition and arrangement of parts may be resorted to by one skilled in the art without departing from the spirit of the invention or scope of the subjoined claims.

I claim:

1. A decorative display device comprising:

a) a transparent housing provided with a bottom opening for filling the housing with a liquid;

b) a cup-shaped sealer snugly fitted within the bottom opening to form a liquidtight seal therewith;

c) a hollow base having a top opening within which a portion of the housing and sealer are received to permit rotation of the housing relative to the base;

d) a wind-up drive mechanism contained within the base and including a power output shaft; and e) a transmission assembly drivingly connecting the sealer to the power output shaft so that rotation of the housing relative to the base and drive mechanism in a first direction causes the drive mechanism to be wound up and unwinding of the drive mechanism causes rotation of the housing relative to the base and drive mechanism in a second opposite direction.

2. The display device of claim 1 wherein the transmission assembly includes:

a) a drive shaft coupled to the sealer and having a first axis of rotation that is coaxial with the axis of rotation of the housing;

b) the power output shaft having a second axis of rotation; and c) the first and second axes of rotation being spaced from and disposed in parallel with each other.

3. The display device of claim 2 wherein the transmission means further includes:

a) a first gear wheel carried by the drive shaft;

b) a second gear wheel carried by the power output shaft; and c) the first and second gear wheels being disposed in meshed engagement with each other.

4. The display device of claim 2, wherein:

a) the sealer includes a downwardly extending hollow cylindrical member;

b) a cylindrical drive socket secured within the cylindrical member and provided with a passageway having a polygonal cross-sectional configuration; and c) the drive shaft including an end of corresponding polygonal cross-sectional configuration engaged within the passageway.

5. The display device of claim 1, wherein:

a) the bottom opening is defined by an outwardly extending neck portion having an annular groove formed around an internal wall thereof;

b) the sealer includes a downwardly extending annular skirt having an outwardly extending annular rib around an outer periphery thereof; and c) the annular rib of the sealer being disposed within the annular groove of the neck portion.

6. The display device of claim 5, wherein the housing is of substantially spherical configuration and the sealer is integrally formed of resilient material.

7. The display device of claim 1, wherein the sealer includes a top portion disposed within the housing for supporting an ornamental object.

8. The display device of claim 1 wherein:

a) the base includes a support plate dividing the interior of the base into upper and lower compartments; and b) the transmission assembly is disposed within the upper compartment and the windup drive mechanism is disposed within the lower compartment.

9. A decorative liquid display device comprising:

a) a transparent spherical housing filled with a liquid and containing an ornamental object immersed in the liquid, the housing including an outwardly extending circular neck portion defining a bottom opening;

b) a resilient cup-shaped sealer snugly fitted within the neck portion and forming a liquid tight seal therewith;

c) a substantially cylindrical-shaped hollow base having a circular top opening through which the neck portion and sealer are received to permit rotation of the housing relative to the base;

d) a circular support plate dividing the interior of the base into upper and lower compartments;

e) a wind-up music box mechanism disposed within the lower compartment and including a power output shaft rotatable about a first axis of rotation;

f) a drive shaft engaged with the sealer for rotation about a second axis of rotation, with the first and second axes of rotation being parallel and spaced from each other; and g) transmission means disposed within the upper compartment and drivingly connecting the power output shaft and the drive shaft, whereby rotation of the housing relative to the base and music box in a first direction causes the music box mechanism to be wound up and unwinding of the music box mechanism causes rotation of the housing relative to the base and music box mechanism in a second opposite direction.

* * * * *